US008689549B2

(12) United States Patent
Jene et al.

(10) Patent No.: US 8,689,549 B2
(45) Date of Patent: Apr. 8, 2014

(54) HYDRAULIC CONTROL CIRCUIT FOR OVERCONTROL OF A SLEWING GEAR DRIVE

(75) Inventors: Thilo Jene, Spiesen-Versberg (DE); Achim Schutz, Nunschweiler (DE)

(73) Assignee: Terex Demag GmbH (DE)

( * ) Notice: Subject to any disclaimer, the term of this patent is extended or adjusted under 35 U.S.C. 154(b) by 911 days.

(21) Appl. No.: 12/743,094

(22) PCT Filed: Nov. 7, 2008

(86) PCT No.: PCT/DE2008/001861

§ 371 (c)(1),
(2), (4) Date: Aug. 10, 2010

(87) PCT Pub. No.: WO2009/062484

PCT Pub. Date: May 22, 2009

(65) Prior Publication Data

US 2010/0313555 A1 Dec. 16, 2010

(30) Foreign Application Priority Data

Nov. 14, 2007 (DE) ..... 10 2007 055 001
Jul. 17, 2008 (DE) ..... 10 2008 034 028

(51) Int. Cl.
*F15B 11/08* (2006.01)

(52) U.S. Cl.
USPC ..... 60/403

(58) Field of Classification Search
USPC ..... 60/444, 466, 403, 404, 405, 428, 429; 303/84.1
See application file for complete search history.

(56) References Cited

U.S. PATENT DOCUMENTS

2003/0079532 A1* 5/2003 Mototani et al. ..... 73/118.2
2005/0205272 A1 9/2005 Suzuki et al.

FOREIGN PATENT DOCUMENTS

DE 102006040459 A1 3/2007
JP 60011704 A 1/1985

OTHER PUBLICATIONS

English Translation of the International Preliminary Report on Patentability for PCT/DE2008/001861 executed on Apr. 30, 2010.
International Search Report for PCTDE2008/001861 dated Mar. 27, 2009.
Written Opinion of the International Searching Authority for PCT/DE2008/001861 dated Mar. 27, 2009.

* cited by examiner

*Primary Examiner* — Edward Look
*Assistant Examiner* — Logan Kraft
(74) *Attorney, Agent, or Firm* — Cantor Colburn LLP

(57) ABSTRACT

A hydraulic control circuit for the overcontrol of a hydraulic system which controls a drive, in particular for controlling a hydraulic motor (5) for driving a slewing gear of a crane superstructure, wherein the pressure lines (3.9, 3.10) for the hydraulic motor (5) are connected by means of a supply piston (3.2) to a hydraulic pump (2) or a tank (1), and the pressure lines (3.9, 3.10) are each assigned pilot valves (3.4, 3.3), shuttle valves (3.8, 3.7) and directional control valves (3.6, 3.5). The shuttle valves (3.7, 3.8) are connected by means of control lines (3.11, 3.12) to an activatable proportional pilot valve (6), such that the separately activatable directional control valves (3.5, 3.6) can thus be activated by means of said pressure, which is built up by the pilot valve (6).

3 Claims, 2 Drawing Sheets

HYDRAULIC CONTROL CIRCUIT FOR OVERCONTROL OF A SLEWING GEAR DRIVE

CROSS REFERENCE TO RELATED APPLICATION

This application claims the benefit of German patent application No 10 2008 034 028.6 filed Jul. 17, 2008 and German patent application No. 10 2007 055 001.6 filed Nov. 14, 2007, the contents of which are incorporated herein by reference thereto.

FIELD OF THE INVENTION

The invention relates to a hydraulic control circuit for overcontrol of the activation of a hydraulic motor for driving a slewing gear or lifting gear or retractable lifting gear of a crane superstructure.

BACKGROUND

The present application is based on DE 10 2006 040 459 A 1. It initially details the prior art in commonly available slewing gear controls.

It subsequently refers to the slewing gear as a device, where a crane superstructure with a corresponding cantilever can freely rotate atop a stationary support structure.

Power is normally provided through a hydraulic motor which positions the superstructure to the support structure through a gearbox with appropriate gearing.

When in operation, the rotational movement must be controllable at a very slow speed while at the same time capable of achieving high speeds to accommodate appropriate work cycles. The dynamic characteristics of the slewing systems vary strongly, dependent on cantilever lengths, reach and load weights. The requirement for the operation of the crane is also determined by its use on construction sites.

It requires a high degree of maneuverability due to resolution and conversion.

The slewing gear controls usually found in moveable cranes are designed as "closed and open circuits." Volume flow- or pressure regulated systems are used within the "open circuits."

In the "closed circuit" a variable displacement pump delivers fluid within a hydraulic circuit directly to the hydraulic motor without having an additional distribution point in the system. The returning oil is directly routed to the pump. Any leakage is fed into the respective return flow area by means of another auxiliary pump.

The delivery volume of the pump determines the speed of the rotational movement. The control valves within the pump regulate the volume, depending on the demand. The pump also determines the delivery direction and thus the rotational direction of the slewing gear. The mechanical/hydraulic valve system makes it possible to pivot the displacement unit of the pump from a maximum position through the neutral position to another maximum position and thus to change a continuous delivery stream from one outlet to another. At the same time the intake sides at the pump change also.

An advantage of this control principle is the fixing of the slewing gear, which to some degree prevents a turning when lateral forces are applied since the hydraulic motor rests on the pump and subsequently on the diesel motor. The fixing of the slewing gear from the "closed circuit" generates an immediate slowing of the rotational speed when the control is reduced. This requires the operator to pay close attention to the rotational movement.

Additional advantages include the positive energy balance as well as the delivery volume, which is determined by the pump geometry, and thus the possibility to move into precise positions.

The increased oil leakage from the hydraulic motor and pump affect the lateral forces negatively since it causes an unwanted drifting of the slewing gear. An additional dynamic rotary brake is required, despite the "closed circuit."

In the "open circuit" a fixed displacement pump usually delivers oil from the tank over a proportional valve to the slewing gear motor. The returning oil flows to the tank through the proportional valve. The valve determines the rotational direction and the delivery volume to the slewing gear motor. Both are controlled by proportional signals depending on the demand.

The proportional valves can function as throttle valves or even as pressure balance valves, which subsequently assures a regulation of the delivered stream independent of the pressure.

Basic throttle controls are perfectly appropriate when the slewing gear is being operated in a very dynamic manner; however they are less controllable with changing loads.

Delivery stream regulators can control or regulate minute speeds independently of the load but are inappropriate for dynamic operations with counter steering. Due to the freewheel mechanism of the sliders the load hook automatically self-centers exactly above the load when the brake is released and the load hook is raised.

A significant disadvantage of "open circuits" is in the deliberate stopping of a movement. Braking is impossible while using the proportional valve since variable loads require different braking forces for a specific braking distance.

Since this option does not exist, in their neutral position the control slides are always in the freewheel mode of the slewing gear motor. A dynamic brake is required for stopping. These brakes are mainly designed as mechanical multiple disk brakes, their handling being equally problematic when it becomes necessary to brake significantly varying loads.

DE 10 2006 040 459.9 A1 reveals a hydraulic control circuit for the control of a hydraulic system which controls a drive, in particular for controlling a hydraulic motor for driving a slewing gear of a crane superstructure, which is characterized in that in both operating lines between a hydraulic fixed displacement pump and a hydraulic motor for controlling the slewing gear, separately activatable directional pilot valves, as well as separately activatable directional control valves, are arranged which are controllable by means of the inflow- and outflow ratio from and to the hydraulic motor and thus control the rotational direction thereof.

In such a hydraulic control circuit two versions are also conceivable:

1. Directional control valves that are "open" in their non-activated mode, i.e. flow through the operating lines and return line to the tank
2. Directional control valves that are "closed" in their non-activated mode, i.e. no flow through the return line to the tank In the case of version 1, loss of energy necessary for activating the directional control valves in this case means an uncontrollable continuous rotational movement based on the inertia of a slewing platform and/or the starting of a rotational movement based on uneven load distribution of a slewing gear, which is at rest. Uncontrollable continuous rotational movements as well as the starting of an unintended rotational movement will pose a safety hazard.

In the case of version 2, loss of the energy necessary for activating the directional control valves in this case means the closure of the drive's discharge lines. This causes the abrupt deceleration of the rotational movement. This involves the risk of mechanical overload on the machine and/or tipping of the machine.

The object of the present invention is to develop a hydraulic circuit in such a manner that even in case of a partial or complete failure of the activation of slewing gear, lifting gear or retractable lifting gear, the machine operator will be able to decelerate and ultimately stop the slewing gear, lifting gear or retractable lifting gear.

SUMMARY

The object according to the invention is achieved by the features of claim 1 and comprises a hydraulic control circuit for the overcontrol of a hydraulic system which controls a drive, in particular for controlling a hydraulic motor for driving a slewing gear of a crane superstructure, wherein the pressure lines for the hydraulic motor are connected by means of a supply piston to a hydraulic pump or a tank, and the pressure lines are each assigned pilot valves, shuttle valves and directional control valves. The shuttle valves are connected by means of control lines to an activatable proportional pilot valve, such that the separately activatable directional control valves can be activated thereby by means of said pressure which is built up by the pilot valve.

BRIEF DESCRIPTION OF THE DRAWINGS

The invention is described below while referencing the drawings.

The drawings are as follows.

DESCRIPTION OF THE EMBODIMENTS

Figure 1:
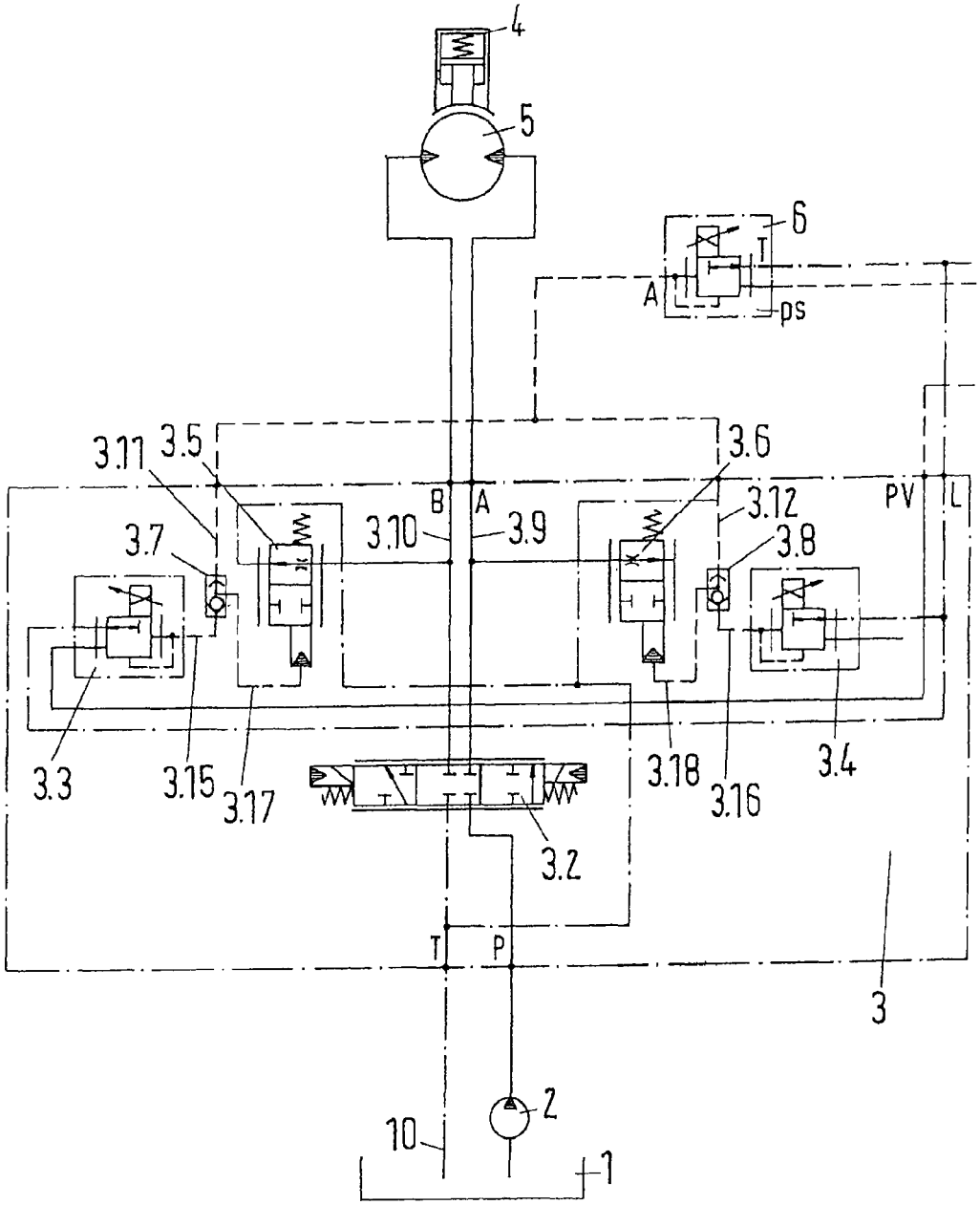
FIG. 1 shows the hydraulic control circuit.

The major structural elements of the present control concept include the following components:

Existing:

Slewing gear control of a mobile crane according to DE 10 2006 040 459 A1.

Additionally:

Shuttle valves 3.7 and 3.8

Control lines 3.11 and 3.12

Directional pressure control valve 6.

Activation of the slewing gear in only one direction is described; activation in the opposite direction occurs correspondingly.

The slewing gear motor 5 is activated by means of the supply piston 3.2. The supply piston determines the rotational direction and rotational speed of the slewing gear motor. This embodiment assumes that the oil flows from pump 2 through the supply piston 3.2, the pressure line 3.9 to the motor 5.

The oil that returns from motor 5 then flows through the pressure line 3.10 to the directional control valve 3.5 and from there through line 10 to tank 1.

The directional control valve is designed in such a manner that a control pressure is required in 3.17 and 3.18 to throttle and close the discharge. Without any control pressure the directional control valves 3.5 and 3.6 release the flow from 3.9 and/or 3.10 through line 10 to tank 1.

In the present example the pilot valve 3.4 is energized so that 3.18 remains closed. The downstream pilot valve 3.3 is (partially) energized so that 3.5 is (partially) opened and releases the flow from 3.10 to 1.

Thus far the description corresponds to that in DE 10 2006 040 459 A1.

Now let us assume a defect in the electrical activation of the pilot valve 3.3 in such a manner that no pilot pressure is generated in 3.15 as well as in 3.17.

Figure 2:
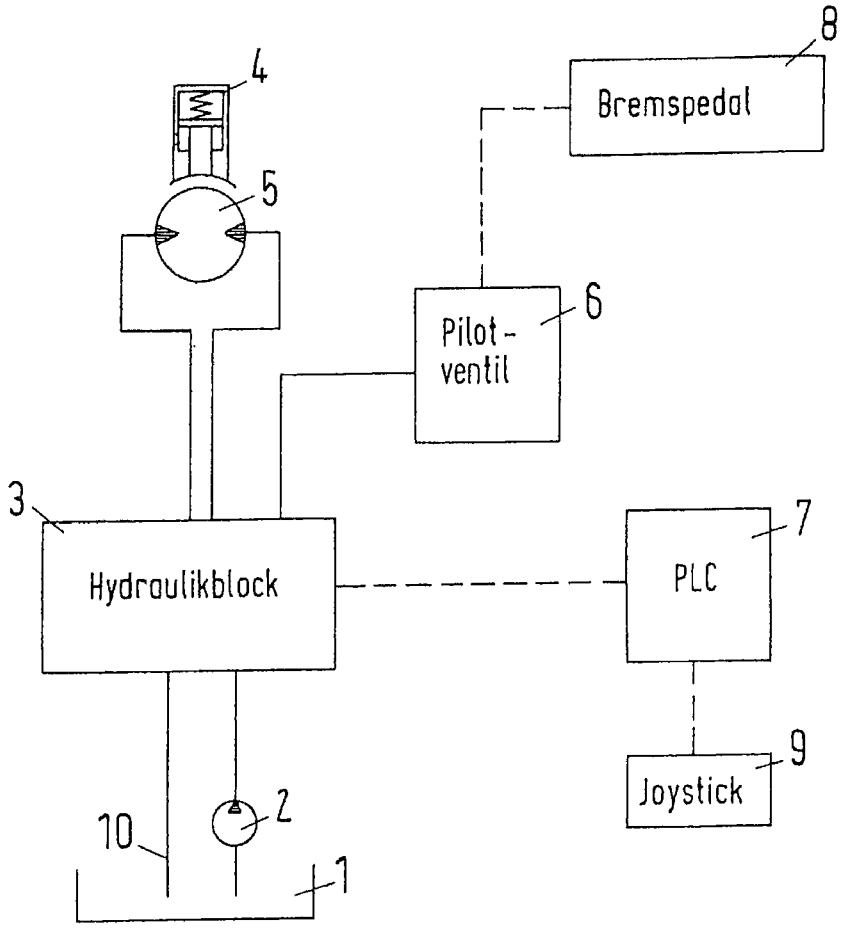
FIG. 2 shows a block diagram including the hydraulic control circuit of FIG. 1.

In this case the spring-loaded directional control valve 3.5 opens the discharge opening. The slewing gear is subsequently in a freewheel mode and can no longer be controlled by the operator through the control elements, i.e. joystick 9, which is illustrated in the block diagram of FIG. 2.

The spring-loaded opening of the directional control valve will prevent an abrupt deceleration of the slewing gear. Under certain conditions (large inertia) this could pose a hazard to the system.

Upon activation of valve 6, for example through a foot-operated brake pedal 8, according to the present invention the operator can now generate a control pressure in 3.11 and 3.12. This has the effect that through the shuttle valves 3.7 and 3.8 a control pressure is generated in 3.17 and 3.18, which throttles both directional control valves 3.5 and 3.6. The throttling takes place proportionately to the generated control pressure. This decelerates the rotational movement, thus preventing the unrestricted rotating of the slewing platform.

Even if the system (partially) fails, the operator consequently always retains control over the rotational movement. According to the present invention, the slewing gear overcontrol can be used as a dynamic service brake even when operating under full capacity.

While the invention has been described with reference to exemplary embodiments, it will be understood by those skilled in the art that various changes may be made and equivalents may be substituted for elements thereof, without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present invention.

The invention claimed is:

1. Hydraulic control circuit for the overcontrol of a hydraulic system which controls a hydraulic motor (5) for driving a slewing gear of a crane superstructure, the hydraulic control circuit comprising: pressure lines (3.9, 3.10) for the hydraulic motor (5), wherein the pressure lines (3.9, 3.10) are connected by means of a supply piston (3.2) to a hydraulic pump (2) or a tank (1), and the pressure lines (3.9, 3.10) are each operatively associated with pilot valves (3.4, 3.3), shuttle valves (3.8, 3.7), and separately activatable directional control valves (3.6, 3.5), wherein a fluid flow to the tank is at least partially controlled by the separately activatable directional control valves (3.6, 3.5), wherein the shuttle valves (3.7, 3.8) are connected by means of first control lines (3.11, 3.12) to an activatable proportional pilot valve (6) and wherein the shuttle valves (3.7, 3.8) are connected by means of second control lines (3.15, 3.16) to pilot valves (3.3, 3.4), such that the separately activatable directional control valves (3.5, 3.6) can be activated thereby by means of pressure which is built up by the proportional pilot valve (6), and separately activated thereby by means of pressure which is built up by the pilot valves (3.3, 3.4).

2. The hydraulic control circuit of claim 1, wherein the shuttle valves (3.7, 3.8) are connected by means of third control lines (3.17, 3.18) to directional control valves (3.5, 3.6).

3. Hydraulic control circuit for the overcontrol of a hydraulic system which controls a hydraulic motor (5) for driving a slewing gear of a crane superstructure, the hydraulic control circuit comprising: pressure lines (3.9, 3.10) for the hydraulic motor (5), wherein the pressure lines (3.9, 3.10) are connected by means of a supply piston (3.2) to a hydraulic pump (2) or a tank (1), and the pressure lines (3.9, 3.10) are each operatively associated with pilot valves (3.4, 3.3), shuttle valves (3.8, 3.7), and separately activatable directional control valves (3.6, 3.5), wherein a fluid flow to the tank is at least partially controlled by the separately activatable directional control valves (3.6, 3.5), wherein the shuttle valves (3.7, 3.8) are connected by means of control lines (3.11, 3.12) to an activatable proportional pilot valve (6), such that the separately activatable directional control valves (3.5, 3.6) can be activated thereby by means of pressure which is built up by the proportional pilot valve (6), and separately activated thereby by means of pressure which is built up by the pilot valves (3.3, 3.4), wherein the pilot valve (6) is activatable by means of a foot brake pedal (8) to build up a control pressure (3.11 and 3.12) and said control pressure (3.11 and 3.12) throttles both directional control valves (3.5 and 3.6) through the shuttle valves (3.7 and 3.8) in the control lines (3.17 and 3.18) such that in addition to the activation as an emergency brake it is also activated as a dynamic service brake.

* * * * *